US005479914A

United States Patent [19]

Tsai

[11] Patent Number: 5,479,914

[45] Date of Patent: Jan. 2, 1996

[54] INTERNAL COMBUSTION GLUE GUN

[76] Inventor: Chin-Lin Tsai, 3F, No. 94, Sec. 4, Chung Hsin Rd., San Chung City, Taipei Hsien, Taiwan

[21] Appl. No.: 349,820

[22] Filed: Dec. 6, 1994

[51] Int. Cl.[6] ..... B65D 5/66; B67D 5/52

[52] U.S. Cl. ..... 126/401; 222/113; 222/146.2; 401/2

[58] Field of Search ..... 126/401; 222/113, 222/146.2; 401/1, 2

[56] References Cited

U.S. PATENT DOCUMENTS

| | | | |
|---|---|---|---|
| 4,795,064 | 1/1989 | Sheu | 222/113 |
| 4,949,881 | 8/1990 | Watanabe | 126/401 |
| 5,048,722 | 9/1991 | Lichu | 126/401 |
| 5,154,322 | 10/1992 | Sim | 126/401 |

*Primary Examiner*—Carroll B. Dority

*Attorney, Agent, or Firm*—Bucknam and Archer

[57] ABSTRACT

An internal combustion glue gun including a glue stick propelling mechanism, a gas release control mechanism, an igniter unit, and a melting unit, and a housing consisting of two symmetrical halves connected together to hold the glue stick propelling mechanism, the gas release control mechanism, the igniter unit, and the melting unit, wherein the housing has a bottom chamber having two pivot pins aligned at a bottom side, a working temperature indicator hole, which receives a temperature detecting chip, which detects the temperature of the melting unit, a gas pressure regulator mounting hole, which receives a gas pressure regulator, a substantially L-shaped switch hole, a switch retainer plate mounted on the switch hole, a collapsible support turned about the pivot pins on the bottom chamber to hold a disposable gas lighter, permitting the disposable gas lighter to be controlled by the switch retainer plate to release gas, and a back opening through which the gas lighter holder can be moved in and out of the bottom chamber.

7 Claims, 5 Drawing Sheets

INTERNAL COMBUSTION GLUE GUN

BACKGROUND OF THE INVENTION

A variety of glue guns have been disclosed, and have appeared on the market. These glue guns include electric glue guns, which use positive-coefficient-temperature electric heaters to produce heat for melting glue sticks, and gas-burning glue guns, which burn fuel gas to melt glue sticks. The common drawback of electric glue guns is that electric glue guns can only be operated within the reachable distance of electric cables. The major advantage of gas-burning glue guns is the mobility. However, when a gas-burning glue gun is used, the gas control switch must be frequently switched on and off during the operation. Furthermore, these gas-burning glue guns are not durable in use because they commonly use heat conductive pads fitted into the combustion chamber to transmit heat to the glue stick.

SUMMARY OF THE INVENTION

The present invention provides an internal combustion glue gun which uses a disposable cigarette lighter controlled by a switch retainer plate to release a flow of fuel gas, permitting it to be burned in a gas chamber to heat a cylinder and a glue stick in the cylinder. A temperature detecting chip is mounted in a hole on the housing of the glue gun to detect the temperature of the combustion chamber. A collapsible support is pivotably connected to the housing for supporting the glue gun on a working surface.

DETAILED DESCRIPTION OF THE PREFERRED EMBODIMENT

Figure 1:
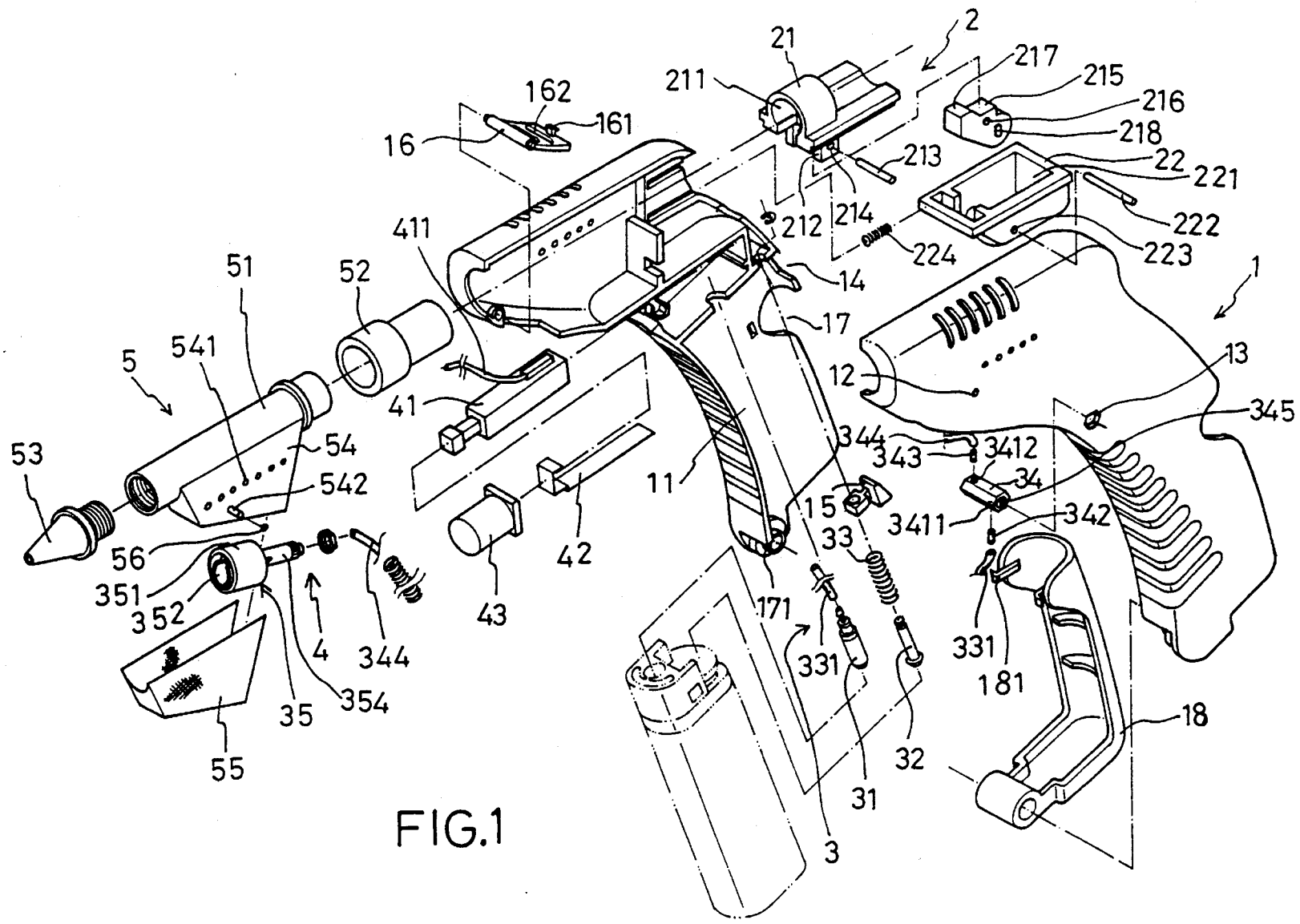
FIG. 1 is an exploded view of an internal combustion glue gun according to the present invention.

Referring to the annexed drawings in detail, an internal combustion glue gun in accordance with the present invention is generally comprised of a housing 1, a glue stick propelling mechanism 2, a gas release control mechanism 3, an igniter unit 4, and a melting unit 5.

The housing 1 is comprised of two symmetrical halves connected together to hold the glue stick propelling mechanism 2, the gas release control mechanism 3, the igniter unit 4, and the melting unit 5, having a bottom chamber 11, a working temperature indicator hole 12, which gives an indication when the temperature reaches the melting point of the glue stick, a gas pressure regulator mounting hole 13, a substantially L-shaped switch hole 14, a switch retainer plate 15 mounted in the switch hole 14, a collapsible support 16 pivotably disposed at a bottom side, which has a retainer rod 161 for fastening the support 16 in the closed position and a view hole 162 for checking the intensity of the flame, a back opening 17, two pivot pins 171 aligned at the bottom of the bottom chamber 11, a substantially L-shaped gas lighter holder 18 turned about the pivot pins 17 to hold a disposable gas lighter and having two hooks 181 for locking the gas lighter holder 18 in the closed position. When the gas lighter holder 18 is locked in the closed position to hold a disposable gas lighter inside the bottom chamber 11, it closes the back opening 17.

The glue stick propelling mechanism 2 is mounted inside the housing 1 at the top, comprised of a glue stick carrier 21, a push block 22, and an actuating bar 215 connected between the glue stick carrier 21 and the push block 22. The glue stick carrier 21 comprises a longitudinal center hole 211, which receives the glue stick, two bottom lugs 212, which have a respective pivot hole 214 aligned with each other. The actuating bar 215 has a tip 217 at one end inserted through the gap between the bottom lugs 212 into the longitudinal center hole 211, an oblong hole 218 at an opposite end disposed inside the inside chamber 221 defined within the push block 22 and connected between two opposite pivot holes 223 on two opposite side walls of the push block 22 by a pivot pin 222, and a pivot hole 216 in the middle pivotably connected between the pivot holes 214 on the bottom lugs 212 by a pivot pin 213. The push block 22 has a front end connected to the inside wall of the housing 1 by a spring 224. When the push block 22 is depressed, the tip 217 of the actuating bar 215 is forced to push the flue stick forwards. When the push block 22 is released from the hand, the spring 224 automatically pushes the push block 22 with the glue stick carrier 21 back to its former position.

The gas release control mechanism 3 comprises a connector 31 for connection to the gas outlet of the disposable gas lighter to be used, a pressure rod 32, and a coil spring 33 mounted around the pressure rod 32. The connector 31 is connected to a gas pressure regulator 34 through a gas tube 331. The pressure rod 32 is connected to the switch retainer plate 15. When the switch retainer plate 15 is moved to the bottom along the switch hole 14, the pressure rod 32 is forced to depress the gas lever of the disposable gas lighter, causing the disposable gas lighter to release gas.

Figure 3:
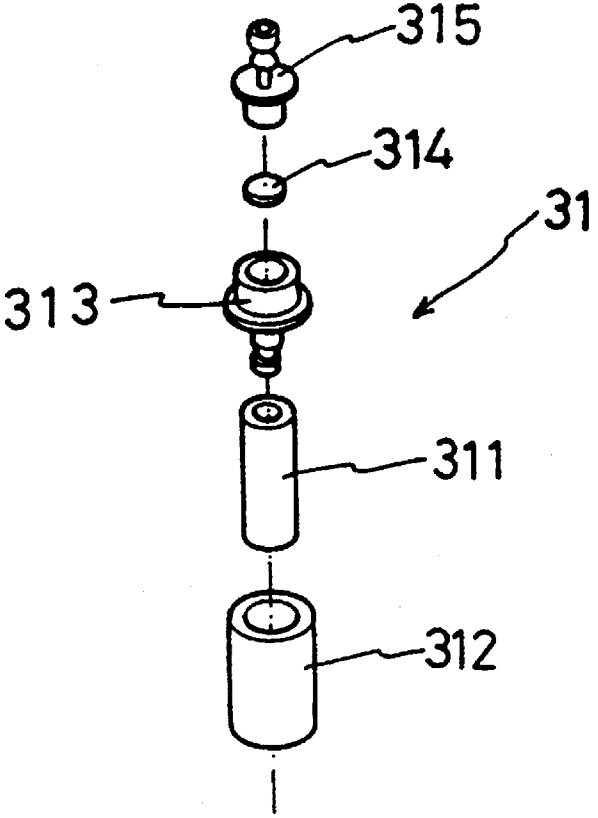
FIG. 3 is an exploded view of the connector of the gas release control mechanism of the internal combustion glue gun shown in FIG. 1.

Referring to FIG. 3, the connector 31 comprises a tube 311, a sleeve 312, which receives the tube 311, a fitting 313 mounted on the sleeve 312 at the top and connected to the top end of the tube 311, an air filter element 314 mounted within the fitting 313, and a gas nozzle 315 connected to the fitting 313 to hold down the gas filter element 314 inside the fitting 313 (see FIG. 3). The gas nozzle 315 has an opposite end connected to a gas pressure regulator 34 through a gas tube 331. The gas pressure regulator 34 is mounted on the gas pressure regulator mounting hole 13.

Figure 4:
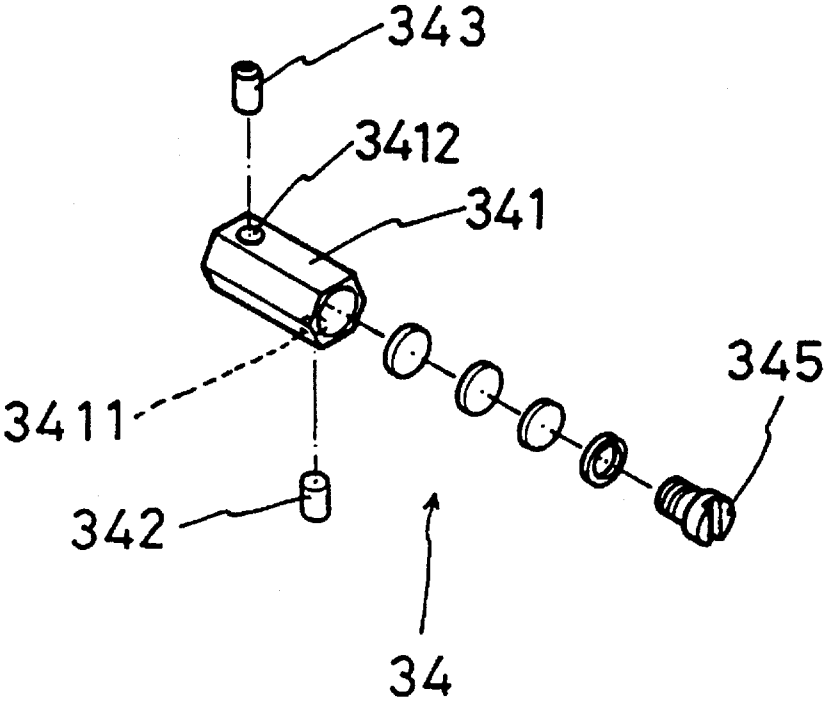
FIG. 4 is an exploded view of the gas pressure regulator of the gas release control mechanism of the internal combustion glue gun shown in FIG. 1.

The aforesaid gas pressure regulator 34, as shown in FIG. 4, comprises a barrel 341 having a gas inlet 3411 at one end connected to the gas tube 331 through a gas inlet valve 342 and a gas outlet 3412 at an opposite end connected to a gas outlet tube 344 through a gas outlet valve 343, and an adjustment screw 345 turned to control the opening of the gas inlet valve 342.

Figure 5:
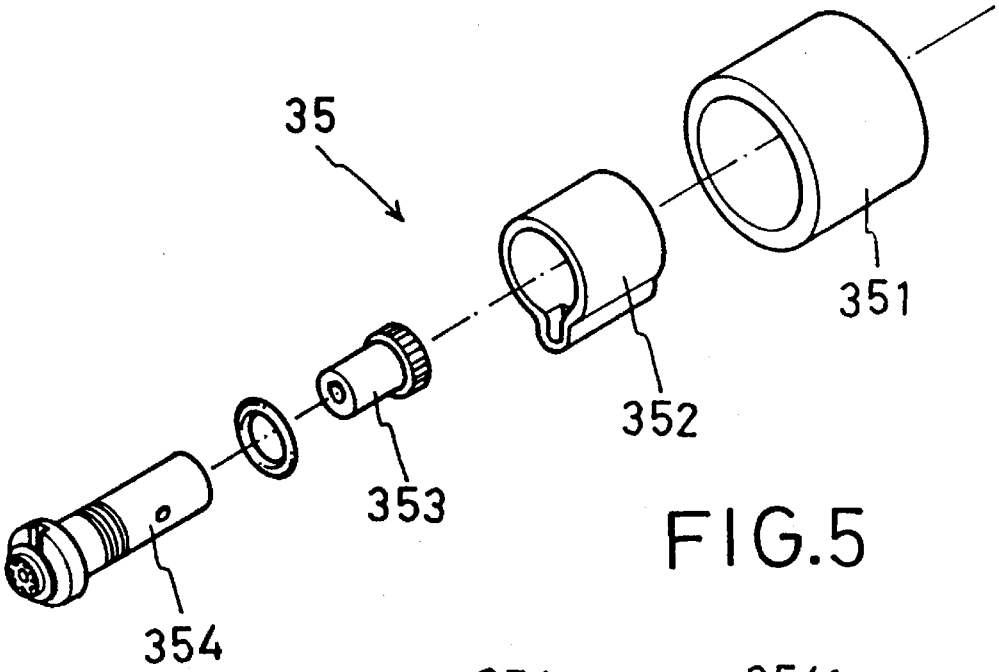
FIG. 5 is an exploded view of the gas nozzle holder of the gas release control mechanism of the internal combustion glue gun shown in FIG. 1.
Figures 1, 5:
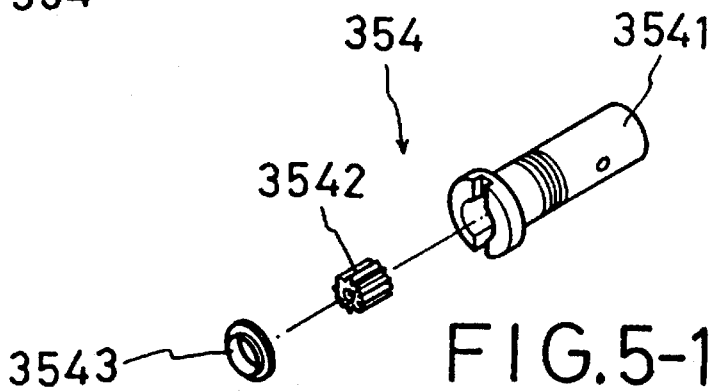
Figures 2, 5:
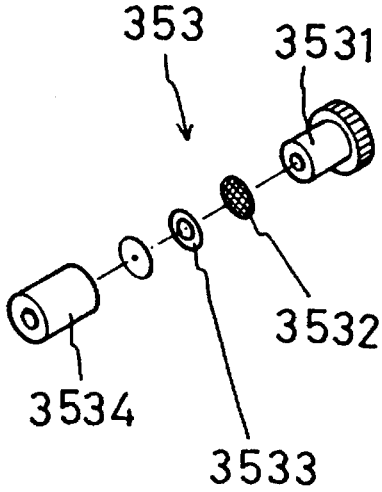

The aforesaid gas outlet tube 344 has one end connected to the gas outlet valve 343 and an opposite end connected to a gas nozzle holder 35. The gas nozzle holder 35, as shown in FIG. 5, comprises a socket 351, a fully clay barrel 352 mounted within the socket 351, a tubular connector 353 mounted within the barrel 352 and connected to the gas outlet valve 343, and a gas nozzle 354 connected to the tubular connector 353. The gas nozzle 354, as shown in FIG. 5-1, comprises a nozzle tube 3541, a nozzle segment plate 3542 mounted inside the nozzle tube 3541, and a ring-like nozzle plug 3543 fastened to the front end of the nozzle tube 3541 to hold the nozzle segment plate 3542 in position. The tubular connector 353, as illustrated in FIG. 5-2, comprises a tubular connector body 3531, a socket 3534 sleeved onto the tubular connector body 3531, a cushion ring 3533 mounted inside the socket 3534, and a wire gauze filter 3532 received inside the socket 3534 and stopped between the connector body 3531 and the cushion ring 3533.

The igniter unit 4 comprises a piezolighter 41 disposed around the gas nozzle 354, a return spring plate 42, and a press button 43. The piezolighter is connected with a wire electrode 411 for the transmission of static electricity. When the press button 43 is depressed, static sparks are discharged through the wire electrode 411 to burn gas at the gas nozzle 354.

The melting unit 5 comprises a cylinder 51, which receives the front end of the glue stick, a silicon rubber socket 52 connected to the center hole 211 of the glue stick carrier 21 to hold the cylinder 51, a glue nozzle 53 connected to the front end (opposite to the socket 52) of the cylinder 51, a combustion chamber 54 disposed around the cylinder 51 between the socket 52 and the glue nozzle 53, and a guard 55 covered over the combustion chamber 54. The combustion chamber 54 has a plurality of vent holes 541 for the circulation of air, and an outside rod 542 fastened with a temperature detecting chip 56. The temperature detecting chip 56 is disposed in the working temperature indicator hole 12. When the temperature of the combustion chamber 54 reaches the predetermined value, the temperature detecting chip 56 is caused to change the color, and therefore the operator knows the heating condition.

Figure 2:
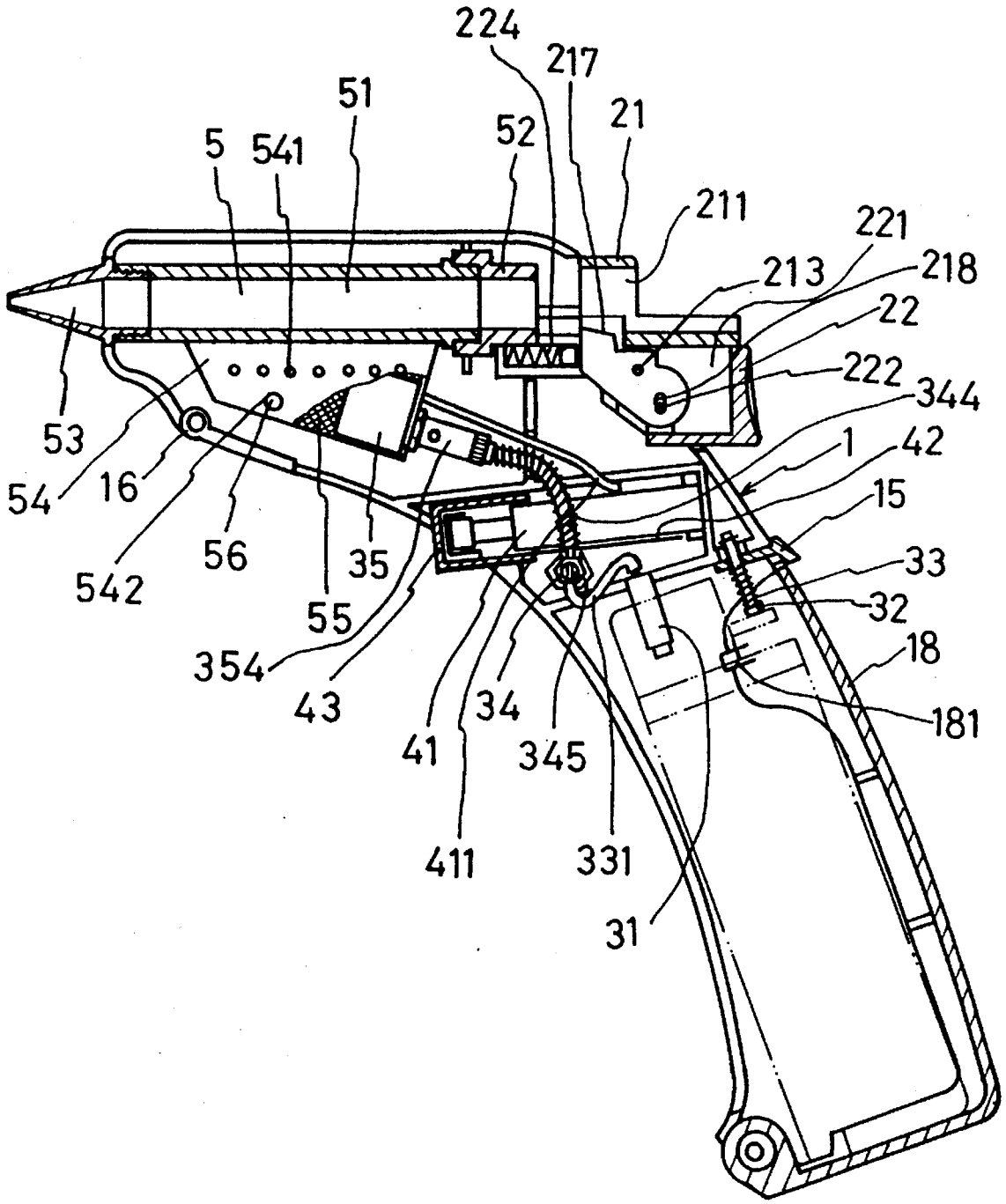
FIG. 2 is a sectional assembly view of the internal combustion glue gun shown in FIG. 1.
Figure 6:
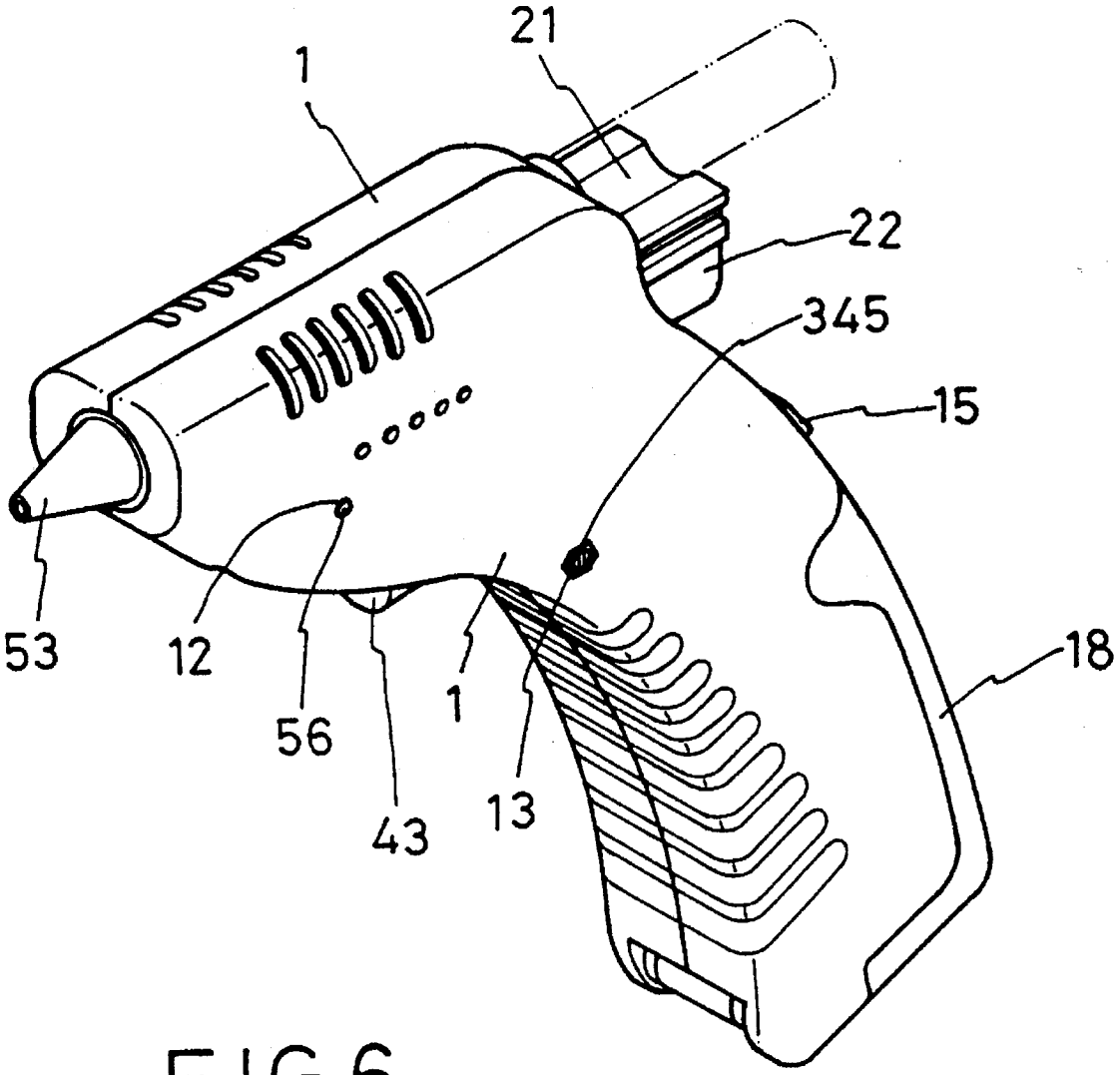
FIG. 6 is an elevational view of the internal combustion glue gun shown in FIG. 1.

Referring to FIGS. 2 and 6, when the switch retainer plate 15 is moved to force the pressure rod 32 against the gas lever of the disposable cigarette lighter, a flow of fuel gas is released from the disposable cigarette lighter and forced into the connector 31, the gas tube 331, the gas pressure regulator 34, the gas outlet tube 344, and the nozzle holder 35, and then driven out of the gas nozzle 354. At the same time, the press button 43 is depressed to trigger the piezolighter 41, causing the piezolighter 41 to discharge sparks, and therefore the flame is produced at the gas nozzle 354 inside the combustion chamber 54 to heat the cylinder 51 of the melting unit 5, causing the front end of the glue stick to be melted. The push block 22 of the glue stick propelling mechanism 2 is then depressed to deliver the glue stick forward, causing molten glue to be driven out of the glue nozzle for application.

During the operation of the glue gun, the intensity of the flame can be regulated by turning the gas pressure regulator 34, and the burning temperature can be checked through the temperature detecting chip 56. When not in use, the switch retainer plate 15 is moved back to its former position to stop gas from the disposable cigarette lighter. The collapsible support 16 can be turned outward from the housing 1 into the operative position to support the glue gun on the work place. Through the view hole 162, the combustion in the combustion chamber 54 is viewed from the outside.

While only one embodiment of the present invention has been shown and described, it will be understood that various modifications and changes could be made without departing from the spirit and scope of the invention.

What is claimed is:

1. An internal combustion glue gun comprising a glue stick propelling mechanism, a gas release control mechanism, an igniter unit, and a melting unit, and a housing comprised of two symmetrical halves connected together to hold said glue stick propelling mechanism, said gas release control mechanism, said igniter unit, and said melting unit, wherein said housing comprises a bottom chamber having two pivot pins aligned at a bottom side, a working temperature indicator hole, which receives a temperature detecting chip, which detects the temperature of said melting unit, a gas pressure regulator mounting hole, which receives a gas pressure regulator, a substantially L-shaped switch hole, a switch retainer plate mounted on said switch hole, a collapsible support turned about the pivot pins on said bottom chamber to hold a disposable gas lighter, permitting the disposable gas lighter to be controlled by said switch retainer plate to release gas, and a back opening through which said gas lighter holder can be moved in and out of said bottom chamber.

2. An internal combustion glue gun comprising a housing, a glue stick propelling mechanism, a gas release control mechanism, an igniter unit, and a melting unit, wherein said glue stick propelling mechanism is mounted inside said housing at a top, comprised of a glue stick carrier having a longitudinal center hole and a glue stick inserted into said longitudinal center hole, a push block extended out of said housing, a spring stopped between said push block and an inside wall of said housing, and an actuation bar connected between said glue stick carrier and said push block and driven directly by said push block to propel the glue stick from said glue stick carrier into said melting unit, the movement of said push block in driving said actuation bar is in the same direction as the movement of said glue stick.

3. An internal combustion glue gun comprising a housing, a glue stick propelling mechanism, a gas release control mechanism, an igniter unit, and a melting unit, wherein said gas release control mechanism comprises a connector connected to the gas outlet of a disposable gas lighter, a pressure rod controlled to depress the gas lever of the disposable gas lighter, and a coil spring mounted around said pressure rod, said connector being connected to a gas pressure regulator through a gas tube to guide fuel gas from the disposable gas lighter to said melting unit.

4. An internal combustion glue gun comprising a housing, a glue stick propelling mechanism, a gas release control mechanism, an igniter unit, and a melting unit, said melting unit comprising a cylinder, which receives a glue stick, a silicon rubber socket, which receives said cylinder, and a glue nozzle connected to one end of said cylinder, wherein a combustion chamber is disposed around said cylinder between said socket and said glue nozzle, and a guard covered over said combustion chamber, said combustion chamber having a plurality of vent holes for the circulation of air and a outside rod mounted with a temperature detecting chip.

5. The internal combustion glue gun of claim 3 wherein said connector comprises a gas tube, a sleeve, which receives said gas tube, a fitting mounted on said sleeve and connected to said gas tube, an air filter element mounted within said fitting, a gas pressure regulator, and a gas nozzle having one end connected to said fitting to hold down said gas filter element inside said fitting and an opposite end connected to said gas pressure regulator through a gas tube.

6. The internal combustion glue gun of claim 5 wherein said gas pressure regulator comprising a barrel, said barrel comprising a gas inlet at one end, a gas inlet valve mounted on said gas inlet, a gas outlet at an opposite end, a gas outlet valve mounted on said gas outlet, and an adjustment screw turned to control the opening of said gas inlet valve.

7. The internal combustion glue gun of claim 6 which further includes a gas nozzle holder which comprises a socket, a fully clay barrel mounted within the socket of said gas nozzle holder, a tubular connector mounted within the barrel of said gas nozzle holder and connected via a tube to said gas outlet valve of said gas pressure regulator, and a gas nozzle connected to the tubular connector of said gas nozzle holder.

* * * * *